US007552852B2

(12) United States Patent
Haskins et al.

(10) Patent No.: US 7,552,852 B2
(45) Date of Patent: Jun. 30, 2009

(54) NAIL HOLDING AND DRIVING DEVICE

(76) Inventors: Michael Lee Haskins, 1803 Warren St., Bellevue, NE (US) 68005; Donna L. Hutchison, 1803 Warren St., Bellevue, NE (US) 68005

( * ) Notice: Subject to any disclaimer, the term of this patent is extended or adjusted under 35 U.S.C. 154(b) by 0 days.

(21) Appl. No.: 11/800,074

(22) Filed: May 3, 2007

(65) Prior Publication Data

US 2007/0262115 A1 Nov. 15, 2007

Related U.S. Application Data

(60) Provisional application No. 60/800,820, filed on May 16, 2006.

(51) Int. Cl.
*B25C 5/06* (2006.01)

(52) U.S. Cl. ..... 227/147; 227/113; 227/156

(58) Field of Classification Search ..... 227/147, 227/113, 156; 81/44; D8/10, 14
See application file for complete search history.

(56) References Cited

U.S. PATENT DOCUMENTS

| | | | | | |
|---|---|---|---|---|---|
| 608,555 | A | | 8/1898 | Nazel | |
| 1,575,582 | A | | 3/1926 | Joy | |
| 2,624,879 | A | | 1/1953 | Baird | |
| 2,666,201 | A | | 1/1954 | Orden | |
| 3,342,228 | A | * | 9/1967 | Reid | 81/44 |
| 3,979,040 | A | * | 9/1976 | Denin | 227/113 |
| 4,120,438 | A | | 10/1978 | Litch | |
| 4,299,021 | A | | 11/1981 | Williams | |
| 4,316,513 | A | | 2/1982 | Harris | |
| 4,483,475 | A | * | 11/1984 | Whitaker | 227/147 |
| 4,562,948 | A | * | 1/1986 | Floyd | 227/147 |
| 5,123,584 | A | | 6/1992 | Harrison | |
| 5,181,644 | A | | 1/1993 | Ferrell | |
| 5,529,234 | A | * | 6/1996 | Juneau | 227/147 |
| 5,605,271 | A | | 2/1997 | Russell | |
| 5,875,950 | A | * | 3/1999 | Nuss et al. | 227/113 |
| 6,598,775 | B1 | * | 7/2003 | Chen | 227/113 |
| 6,783,048 | B2 | | 8/2004 | Powell | |
| 6,968,989 | B1 | | 11/2005 | Hall, Jr. | |
| 2004/0065710 | A1 | | 4/2004 | Powell | |

* cited by examiner

*Primary Examiner*—Rinaldi I. Rada
*Assistant Examiner*—Michelle Lopez
(74) *Attorney, Agent, or Firm*—Stinson Morrison Hecker LLP

(57) ABSTRACT

A nail holding and driving device includes an elongated generally non-magnetically conductive main tube and a magnet movably mounted on the outer wall of the main tube. A nail-driving rod is slidably housed within the main tube, the nail-driving rod being constructed of a magnetically conductive material and having a nail engaging and striking lower impact end face and an impact-receiving upper end. The magnet is operative to magnetize the nail-driving rod through the main tube. The nail-driving rod is operative to magnetically engage a nail to support the nail within the main tube in contact with the nail engaging and striking lower end of the nail-driving rod and drive the nail into the desired location by impact of a nail-driving device with the impact-receiving upper end of the nail-driving rod.

19 Claims, 4 Drawing Sheets

NAIL HOLDING AND DRIVING DEVICE

CROSS-REFERENCE TO RELATED PATENTS

This application claims the benefit of U.S. Provisional Application No. 60/800,820, filed May 16, 2006.

BACKGROUND OF THE INVENTION

1. Technical Field

The present invention relates to nail positioning and driving devices and, more particularly, to a nail holding and driving device for use with very small, difficult-to-hold nails which includes a generally cylindrical main tube, a toroidal magnet movably mounted on the outer wall of the main tube and a generally cylindrical nail-driving rod which is slidably housed within the main tube, the nail-driving rod being constructed of a ferrous metal material such that the toroidal magnet magnetizes the nail-driving rod so that the rod, when encountering a metal nail, will magnetically engage the nail to support the nail within the main tube in contact with the nail-driving rod prior to the nail being inserted into the desired location by impact of a hammer or other nail-driving device with the upper end of the nail-driving rod.

2. Description of the Prior Art

There are many hobbies which involve building or constructing models of larger structures, such as airplanes, cars, ships and buildings. While construction of each of these types of models can be enjoyable, one of the most challenging yet rewarding types of miniatures and models to construct are those which replicate buildings and the various furnishings which go into buildings. While some types of models and miniatures can be constructed by use of glue, clips or the like, the more sophisticated and challenging miniatures involve the use of very small nails and other miniature fasteners which are used to secure elements of the miniature to one another. These nails range in size anywhere from an inch and a half in length down to nails which are less than three eighths of an inch in length, which are used for such purposes as securing miniature hinges to a door jam, joining very small or very fine pieces of wood to one another, or other such purposes.

One of the significant problems encountered in using such very small nails, however, is that holding the nail in the proper position prior to insertion is very difficult, and it may be even more difficult to properly drive the nail, due to the way in which one must hold the nail for proper insertion. It is common for persons attempting to insert such small nails to grasp the nails using long nosed or needle nosed pliers and then tap the nail to partially insert the nail prior to completing the hammering process. While this procedure will work for many persons who participate in the hobby of building miniatures, as the hobbyists become older or lose some degree of the hand-eye coordination they have come to rely on, it becomes more and more difficult to hold the nail while simultaneously inserting and driving it with the hammer. It can become virtually impossible for such persons to continue to enjoy the hobby in which they have invested so much of their time and effort to become proficient, and therefore there is a need for a device which is usable not only to hold a very small nail in the proper location for driving of the nail but also can be used to drive the nail without requiring additional support devices such as needle nosed or long nosed pliers, thereby permitting even those persons who are unsteady or somewhat infirm to continue to practice their beloved hobby.

Therefore, an object of the present invention is to provide an improved nail holding and driving device.

Another object of the present invention is to provide an improved nail holding and driving device which will magnetically engage a nail, support and properly position it for insertion into the material into which the nail is to be driven and facilitate driving of the nail into the material by providing an easier-to-impact hitting surface to be hit by the user.

Another object of the present invention is to provide an improved nail holding and driving device which includes a generally cylindrical main tube, a toroidal magnet movably mounted on the outer wall of the main tube and a generally cylindrical nail-driving rod which is slidably housed within the main tube, the nail-driving rod being constructed of a ferrous metal material such that the toroidal magnet magnetizes the nail-driving rod so that the rod, when encountering a metal nail, will magnetically engage the nail to support the nail within the main tube in contact with the nail-driving rod prior to the nail being inserted into the desired location by impact of a hammer or other nail-driving device with the upper end of the nail-driving rod.

Another object of the present invention is to provide an improved nail holding and driving device which can be used with very small and hard-to-grip nails to facilitate insertion of those nails in the desired installation location.

Finally, an object of the present invention is to provide an improved nail holding and driving device which is relatively simple and durable in construction and is safe, efficient and effective in use.

SUMMARY OF THE INVENTION

The present invention provides a nail holding and driving device including an elongated generally non-magnetically conductive main tube and a magnet movably mounted on the outer wall of the main tube. A nail-driving rod is slidably housed within the main tube, the nail-driving rod being constructed of a magnetically conductive material and having a nail engaging and striking lower impact end face and an impact-receiving upper end. The magnet is operative to magnetize the nail-driving rod through the main tube. Finally, the nail-driving rod is operative to magnetically engage a nail to support the nail within the main tube in contact with the nail engaging and striking lower end of the nail-driving rod and drive the nail into the desired location by impact of a nail-driving device with the impact-receiving upper end of the nail-driving rod.

The present invention as thus described provides substantial advantages over those nail holding and driving devices found in the prior art. For example, because the strength of the magnetic bond between the magnet and the lower impact end face of the nail-driving rod may be modified or changed somewhat merely by moving the magnet towards or away from the lower end of the nail-driving rod, the size and weight of nails able to picked up and retained by the present invention may be modified, as can the force required to separated the mail from the nail-driving rod, thus increasing the functional flexibility of the present invention. Furthermore, the fact that the magnet and the nail-driving rod are separate from one another, i.e., the nail-driving rod is not a permanent magnet, means that if the nail-driving rod becomes damaged due to the repeated impacts that the rod will undergo, replacement or repair of the rod is far easier than that encountered in connection with prior art devices, where the rod is constructed of a permanent magnet construction material. Finally, because the present invention is capable of being used with very small nails, it is believed that it will provide many advantages to persons having reduced or subpar fine motor skills, whether caused by advancing age or other physical causes. It is therefore seen that the present invention provides a substantial improvement over those nail holding and inserting devices found in the prior art.

DESCRIPTION OF THE PREFERRED EMBODIMENT

Figure 1:
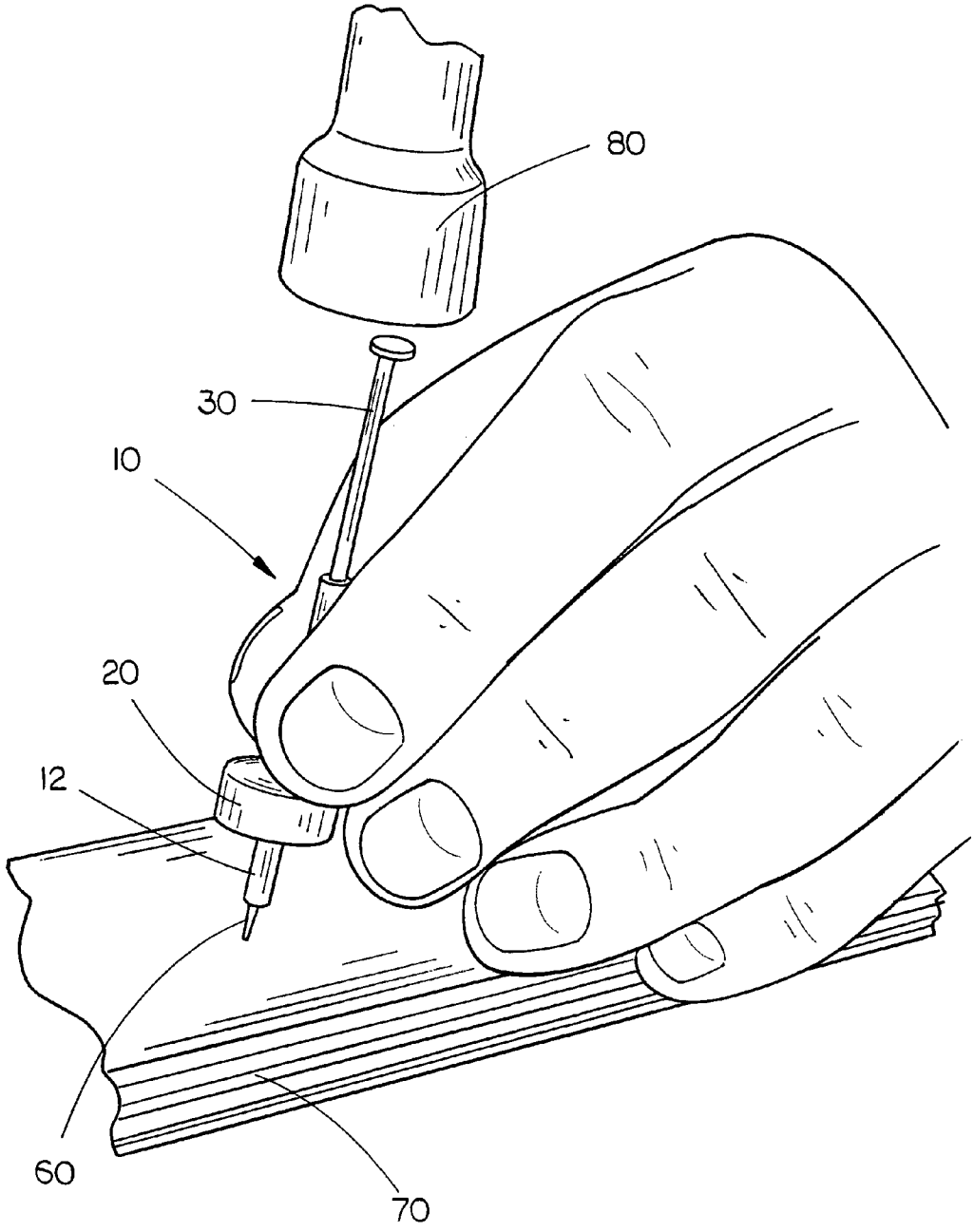
FIG. 1 is a perspective view of the nail holding and driving device of the present invention being used to drive a nail into a piece of wood.
Figure 2:
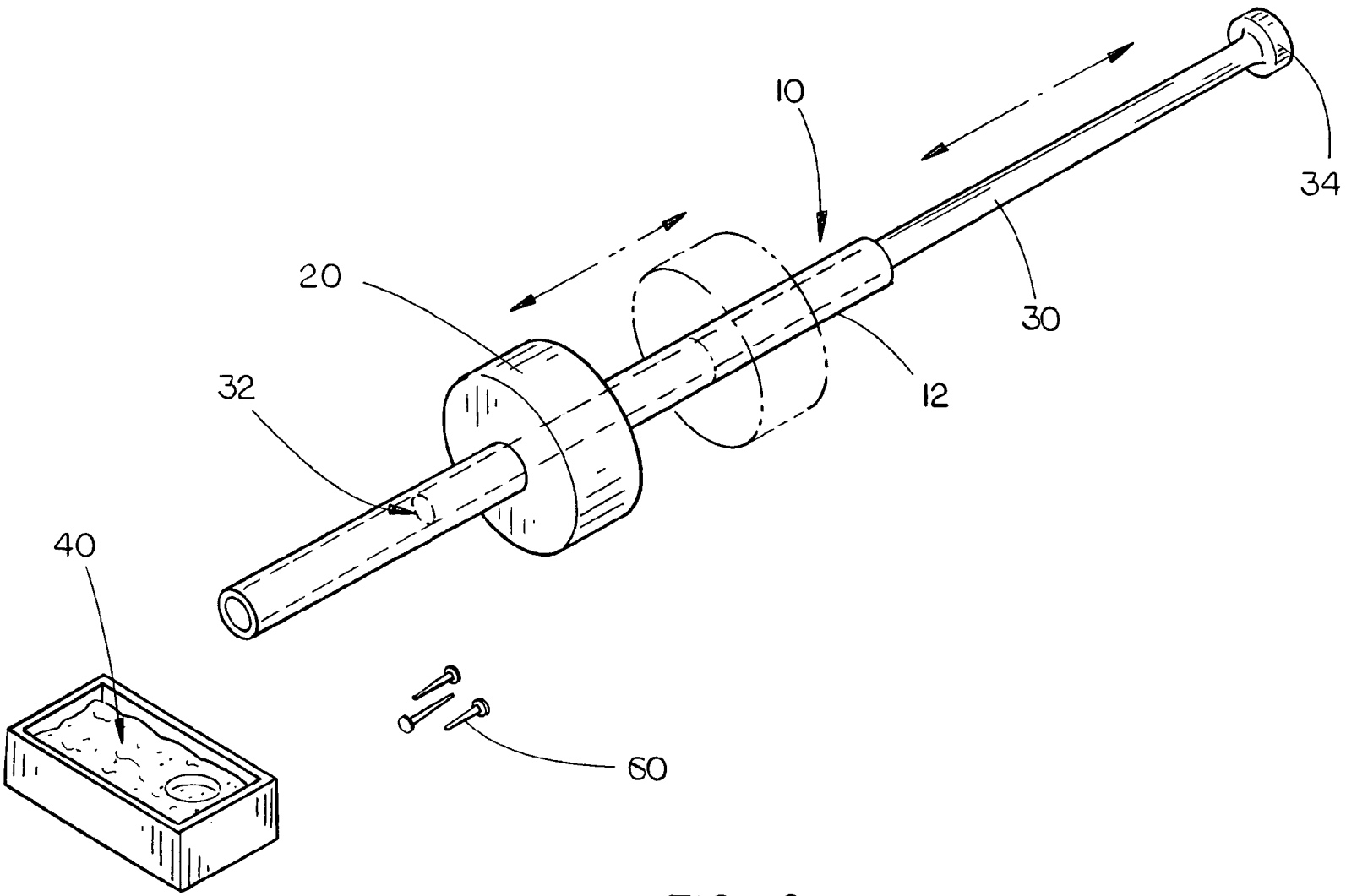
FIG. 2 is a perspective view showing the internal elements of the device with the nail-driving rod sliding within the main tube.
Figure 3:
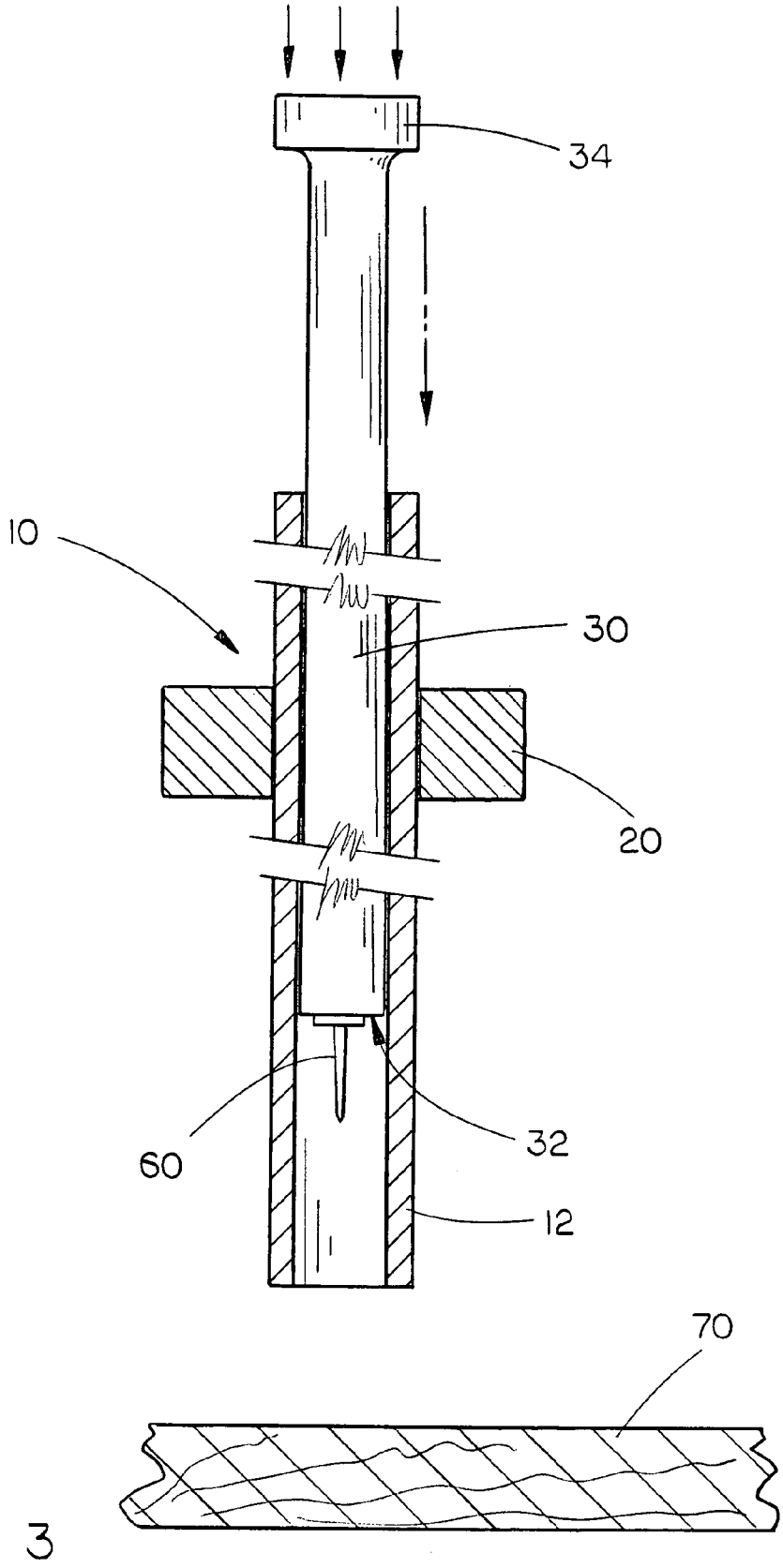
FIG. 3 is a detailed side elevational view of the present invention showing a nail being magnetically supported on the end of the nail-driving rod via the magnetic force exerted by the toroidal magnet.

The nail holding and nail driving device 10 of the present invention is shown best in FIGS. 1-3 as including a generally cylindrical main tube 12 which, in the preferred embodiment, would have a length of approximately one to two inches, an external diameter of approximately 1/16 inch to 1/4 of an inch and an internal diameter of approximately 0.05 inches to 0.3 inches. It is further preferred that the main tube 12 be constructed of a non-ferrous material such as aluminum, brass or copper so that the main tube 12 is generally non-magnetic. Additionally, it should be noted that the internal diameter of the main tube 12 will generally correspond to the size of the nails with which the nail holding and driving device 10 is to be used, and therefore it is expected that several different sizes of main tubes 12 may be used in connection with the present invention in order to accommodate various sizes of nails therewithin.

Frictionally mounted on the outer wall of the main tube 12 is a toroidal or ring-shaped permanent magnet 20 which, in the preferred embodiment, would consist of any appropriate type of permanent magnet, such as a rare earth magnet, a ferrite magnet, a samarium cobalt magnet, an AlNiCo magnet, or virtually any other type of permanent magnet so long as the magnet provides sufficient magnet strength for the proper operation of the present invention, as will be described herein. In the preferred embodiment, the toroidal magnet 20 would fit snugly onto the main tube 12 to act as a grip or handle that can also be slid up and down the main tube 12 to adjust the positioning of the toroidal magnet 20 thereon as desired. It is important to note, however, that the strength of the toroidal magnet 20 must fall within a relatively narrow range for the operational reasons described below.

Also, it should be noted that the toroidal magnet 20 will generally be used as a grip for the holding of the nail holding and nail driving device 10 and as such will preferably include a gripable outer surface such as a molded plastic cover or rubber coating material. Furthermore, references to the toroidal magnet 20 also should be understood to represent the preferred shape of the grip component of the magnet, as opposed to the shape of the magnetic material itself. Of course, the magnetic material may be of many different sizes and shapes within the toroidal magnet 20, and it has been found that a preferred configuration for the magnetic material would include a pair of bar magnets housed within the toroidal magnet 20 which are oriented such that the magnetic forces exerted by each of the bar magnets work in concert with one another to produce the overall magnetic force applied by the toroidal magnet 20. However, many different configurations of magnets and magnetic material may be used within the toroidal magnet 20 of the present invention so long as the magnetic force applied provides sufficient magnet strength for the proper operation of the present invention.

A nail-driving rod 30 extends within main tube 12 as shown best in FIGS. 1-3, the nail-driving rod 30 having a length of approximately 1 to 2 inches and an external diameter which is approximately 0.01 inches less than the internal diameter of the main tube 12 in which the nail-driving rod 30 is extended. Furthermore, it is preferred that the nail-driving rod 30 be constructed of a hard ferrous magnetic material such as iron or steel and that the nail-driving rod 30 include a lower generally flat impact face 32 and an upper head 34 which is a generally flat disk or anvil-shaped body formed on the top end of the nail-driving rod 30 in the same general manner as is commonly found with nails or the like. The nail-driving rod 30 is thus slidably housed within the main tube 12 with the upper head 34 positioned outside the top end of the main tube 12.

The nail holding and driving device 10 of the present invention is used in the following manner. First of all, when the nail-driving rod 30 is slidably housed within the main tube 12, the magnet 20 acts to attract the nail-driving rod 30 due to its construction from the ferrous magnetic material. This helps to magnetically secure the nail-driving rod 30 within the main tube 12, while also magnetizing the rod 30 via the transfer of the magnetic force from magnet 20 to the nail-driving rod 30. The magnetization of the nail-driving rod 30 enables the user of the present invention to use the nail-driving rod 30 to pick up the nail 60 which is to be inserted into the wood block 70, as shown in FIG. 1. With a nail 60 made of ferrous material, when the nail-driving rod 30, particularly impact face 32, approaches the vicinity of the end of the nail 60, the nail 60 is drawn into contact with the impact face 32 of nail-driving rod 30 via the magnetic force transferred through the nail-driving rod 30 from the magnet 20. As the nail-driving rod 30 is drawn upwards into and through the main tube 12, the nail 60 is retained on the impact face 32 of nail-driving rod 30, as shown best in FIG. 3. The nail holding and driving device 10 would then be moved to the appropriate location on the wood block 70 and when the device is properly positioned, the nail-driving rod 30 would be extended downwards through the main tube 12 until the insertion end of the nail 60 is adjacent the wood block 70, as shown best in FIG. 1. The individual using the nail holding and driving device 10 of the present invention would then impact the upper head 34 of nail-driving rod 30 with a hammer 80 or the like, such that the impact force of the hammer 80 hitting the upper head 34 drives the nail-driving rod 30 downwards within main tube 12 to force the nail 60 into the wood block 70 via contact with the impact face 32 of nail-driving rod 30. Following initial insertion of the nail 60, the nail holding and driving device 10 may be removed from contact with the nail 60, with the magnetic attraction between the impact face 32 of nail-driving rod 30 and the nail 60 being broken by applying upward force on the nail holding and driving device 10, or the device itself may be used to drive the nail 60 completely into the wood block 70 by impacting the nail-driving rod 30 with the hammer 80. This is one of the significant advantages of the present invention, as the vast majority of nail-holding devices cannot be used for driving the nail into the substrate material such as the block of wood 70, whereas the nail holding and driving device 10 of the present invention is specifically designed to enable the user to drive the nail 60 via impact of the hammer 80 with the nail-driving rod 30. Finally, once the nail 60 is driven, the nail holding and driving device 10 is then ready for driving of the next nail in the desired location.

Figure 4:
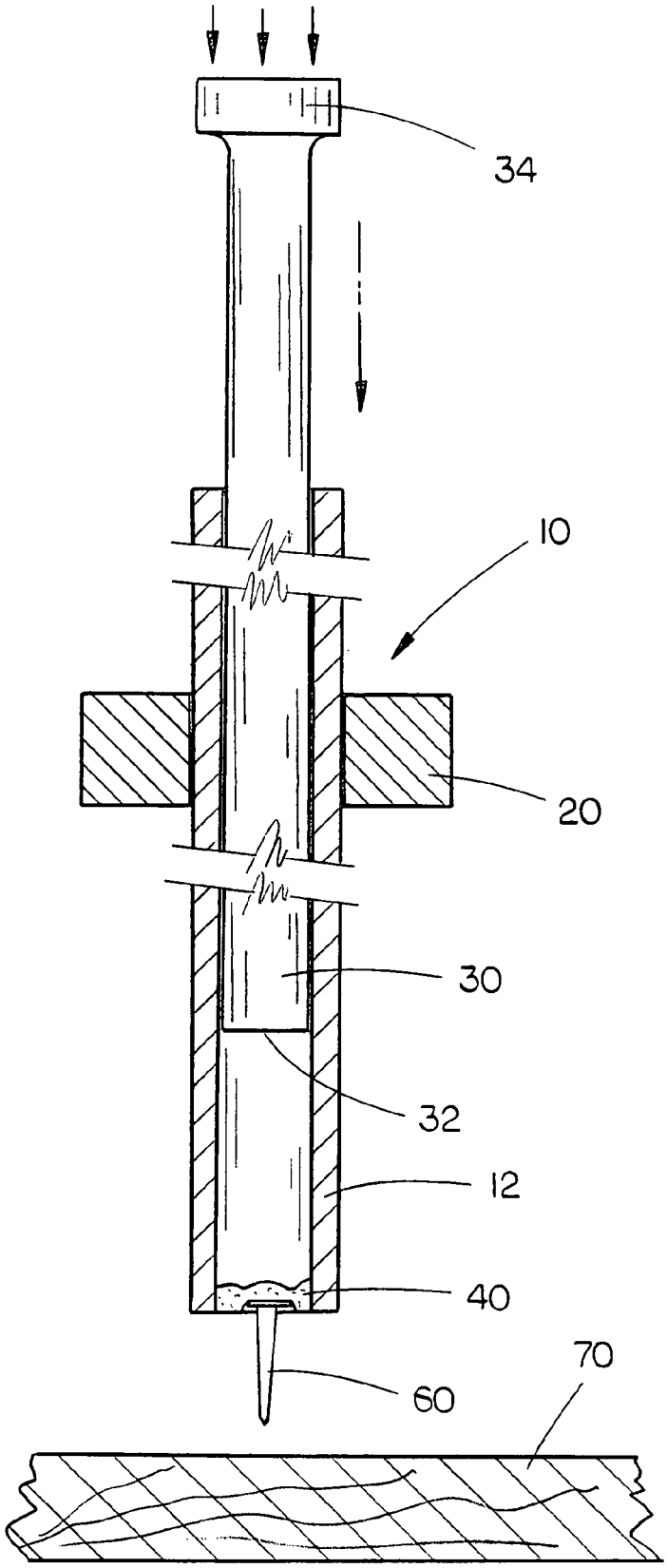
FIG. 4 is a detailed side elevational view of the present invention showing how a small amount of putty may be used to support a non-magnetic nail immediately prior to insertion and driving of the nail.

It is a frequent occurrence that nails 60 which are to be driven into a substrate material are not constructed of ferrous materials, being instead constructed of brass or another such non-ferrous material, and therefore cannot be magnetically secured on the impact face 32 of nail-driving rod 30. In such situations, a simple and elegant solution engendered by use of the nail holding and driving device 10 of the present invention is available, as shown best in FIGS. 2 and 4. In these figures, it is seen that an amount of a putty-type material 40 such as hobby putty or the like is made available and the lower end of main tube 12 is inserted into the putty-type material such that a small amount of the putty-type material 40 is retained within the main tube 12, as shown best in FIG. 4. The nail 60 to be inserted into the wood 70 would first be partially inserted into the putty-type material 40 with the head of the nail embedded in the putty-type material 40, again as shown in FIG. 4. This supports the nail 60 within the main tube 12 in a sufficiently secure manner to enable the user of the nail holding and driving device 10 of the present invention to place and align the nail 60 in the proper position over the wood block 70 into which it is to be inserted. The nail holding and driving device 10 would then be used in the manner described previously, wherein the nail-driving rod 30 is slid downwards through main tube 12 until it contacts the putty-type material 40, at which time the upper head 34 of the nail-driving rod 30 is impacted with a hammer or the like to drive the nail-driving rod 30 downwards within main tube 12. The impact face 32 of nail-driving rod 30 impacts the nail 60 through the putty-type material 40, thus driving the nail 60 into the wood block 70. Once the nail 60 is inserted into the wood block 70, the putty-type material 40 which has been dislodged from the lower end of the main tube 12 may be quickly and easily removed from the vicinity of the inserted nail, and the same procedure may be used in connection with the next nail to be inserted.

It should also be noted that the toroidal magnet 20, although designed primarily to act as a grip or handle, is movably mounted on the main tube 12 to be slid up and down thereon to adjust the positioning of the toroidal magnet 20 and hence the magnetic force being applied at the lower impact face 32 of nail-driving rod 30 will likewise be increased or decreased as the toroidal magnet 20 is moved towards or away from the lower section of the main tube 12. This adjustability of the magnetic strength is of significant importance, as the weight of the nail 60 will vary with the size and shape of the nail 60, and therefore greater or lesser magnetic force will be required to retain the nail 60 in magnetic connection with the impact face 32 of nail-driving rod 30. The prior art does not disclose such magnetic force adjustability, and therefore it is believed that the inclusion of this feature in the present invention provides a significant protectable improvement over those prior art devices which are intended to function in similar fashion.

It is to be understood that numerous additions, modifications and substitutions may be made to the nail holding and driving device 10 of the present invention which fall within the intended broad scope of the above description. For example, the size, shape and construction elements used in connection with the various elements of the present invention may be modified or changed so long as the intended non-ferrous construction materials used in connection with main tube 12, ferrous construction materials used in connection with nail-driving rod 30, and permanent magnet construction materials used in connection with magnet 20 are generally maintained. Furthermore, although the present invention has been described for use particularly in connection with nails, it should be noted that various other types of fastening devices such as screws may be used with the nail holding and driving device 10 of the present invention for their initial insertion, and such use would be understood by one skilled in the art of fastener usage. Also, it should be noted that the toroidal magnet 20 may be modified or changed in terms of the size and strength of the magnet 20, and in fact one alternative embodiment of the present invention would substitute a magnetized material for the construction material of nail-driving rod 30 so that the nail-driving rod 30 is itself independently magnetized for magnetic connection to fasteners which are to be inserted. However, as the majority of magnetic materials do not have sufficient impact resistance for use in the manner described in connection with nail-driving rod 30, it is believed that the arrangement described herein of the toroidal magnet 20 mounted on and nail-driving rod 30 mounted within main tube 12 provides the best solution for proper operation of the nail holding and driving device 10. A second alternative embodiment would include an inner magnetic lining formed on the inner wall of the main tube 12 which substitutes for the magnet 20, and the process for lining the main tube 12 would be understood by one skilled in the art of working with magnetic materials. Finally, although the putty-type material 40 use in connection with the insertion of non-magnetic nails and fasteners into substrate material has been described with some particularity, it should be noted that virtually any type of inert material, having the general consistency of putty which is used in connection with wood-type materials, may be used with the present invention in the manner described previously.

There has therefore been shown and described a nail holding and driving device 10 which accomplishes at least all of its intended objectives.

We claim:

1. A nail holding and driving device comprising:

an elongated generally non-magnetically conductive main tube;

a magnet movably mounted on the outer wall of said main tube;

a nail-driving rod slidably housed within the main tube, said nail-driving rod being constructed of a magnetically conductive material and having a nail engaging and striking lower impact end face and an impact-receiving upper end;

said magnet operative to magnetize said nail-driving rod through said main tube;

said nail-driving rod operative to magnetically engage a nail to support the nail within said main tube in contact with said nail engaging and striking lower impact end face of said nail-driving rod and drive the nail into the desired location by impact of a nail-driving device with said impact-receiving upper end of said nail-driving rod.

2. The nail holding and driving device of claim 1 wherein said main tube is constructed of a non-ferrous metal.

3. The nail holding and driving device of claim 1 wherein said magnet is a generally toroidal shape extending circumferentially around said main tube.

4. The nail holding and driving device of claim 1 wherein said nail-driving rod is at least partially constructed of a ferrous metal.

5. The nail holding and driving device of claim 3 wherein said magnet is slidably mounted on said main tube such that said magnet may be slid upwards and downwards on said main tube.

6. A nail holding and driving device comprising:

an elongated generally cylindrical non-magnetically conductive main tube having a lower section;

a gripable magnet slidably mounted on the outer wall of said main tube;

a generally cylindrical nail-driving rod slidably housed within the main tube, said nail-driving rod being constructed of a magnetically conductive material and having a nail engaging and striking lower impact end face and an impact-receiving upper end;

said magnet operative to magnetize said nail-driving rod through said main tube;

said nail-driving rod operative to magnetically engage a nail to support the nail within said main tube in contact with said nail engaging and striking lower impact end face of said nail-driving rod and drive the nail into the desired location by impact of a nail-driving device with said impact-receiving upper end of said nail-driving rod; and said gripable magnet being movable such that the magnetic force being applied at said lower impact face of said generally cylindrical nail-driving rod is alternatively increased and decreased as said gripable magnet is alternatively moved towards and away from said lower section of said main tube.

7. The nail holding and driving device of claim 6 wherein said main tube is constructed of a non-ferrous metal.

8. The nail holding and driving device of claim 6 wherein said nail-driving rod is at least partially constructed of a ferrous metal.

9. The nail holding and driving device of claim 1, further comprising a putty-type material removably adhered within said main tube such that said material supports the nail within said main tube.

10. The nail holding and driving device of claim 1, wherein said magnet comprises a gripable outer surface.

11. The nail holding and driving device of claim 10, wherein said gripable outer surface comprises a molded cover.

12. The nail holding and driving device of claim 10, wherein said gripable outer surface comprises a coating material.

13. The nail holding and driving device of claim 6, further comprising a putty-type material removably adhered within said main tube such that said material supports the nail within said main tube.

14. The nail holding and driving device of claim 6, wherein said gripable magnet comprises a molded cover.

15. The nail holding and driving device of claim 6, wherein said gripable magnet comprises a coating material.

16. A nail holding and driving device comprising:

an elongated generally non-magnetically conductive main tube having an interior surface;

a nail-driving rod slidably housed within said main tube, said nail-driving rod being constructed of a magnetically conductive material and having a nail engaging and striking lower impact end face and an impact-receiving upper end; and a magnetic lining positioned along at least a portion of said interior surface of said main tube, said magnetic lining operative to magnetize said nail-driving rod such that said nail-driving rod is operative to magnetically engage a nail to support the nail within said main tube in contact with said nail engaging and striking lower impact end face of said nail-driving rod and drive the nail into the desired location by impact of a nail-driving device with said impact-receiving upper end of said nail-driving rod.

17. The nail holding and driving device of claim 16, wherein said main tube is constructed of a non-ferrous metal.

18. The nail holding and driving device of claim 16, wherein said nail-driving rod is at least partially constructed of a ferrous metal.

19. The nail holding and driving device of claim 16, further comprising a putty-type material removably adhered within said main tube such that said material supports the nail within said main tube.

* * * * *